United States Patent [19]

Dettmer

[11] Patent Number: 4,595,918

[45] Date of Patent: Jun. 17, 1986

[54] STROKE WRITING CHARACTER GENERATOR WITH REDUCED BANDWIDTH

[75] Inventor: Jay R. Dettmer, Columbia, Md.

[73] Assignee: Sperry Corporation, New York, N.Y.

[21] Appl. No.: 528,834

[22] Filed: Sep. 2, 1983

[51] Int. Cl.[4] ..... G09G 1/10

[52] U.S. Cl. ..... 340/739; 340/736

[58] Field of Search ..... 340/736, 739, 740, 741, 340/742

[56] References Cited

U.S. PATENT DOCUMENTS

| | | | |
|---|---|---|---|
| 3,717,782 | 2/1973 | Snook et al. | 340/739 |
| 3,984,827 | 10/1976 | Hickin et al. | 340/739 |
| 4,369,441 | 1/1983 | Wohlmuth | 340/739 |

*Primary Examiner*—Gerald L. Brigance
*Assistant Examiner*—Jeffery A. Brier
*Attorney, Agent, or Firm*—Howard P. Terry; Seymour Levine

[57] ABSTRACT

A stroke writing character generator pauses between the generation of vectors, which may meet at sharp corners, so as to reduce deflection bandwidth. A stroke state machine having a plurality of states controls the generation of the vectors. The plurality of states includes a time pause state. A vector length counter provides an end of vector signal that causes the stroke state machine to enter the time pause state for inserting a time pause between the generation of the vectors. The video of the CRT on which the vectors are written is blanked in coincidence with the time pause.

1 Claim, 7 Drawing Figures

FIG. 1.
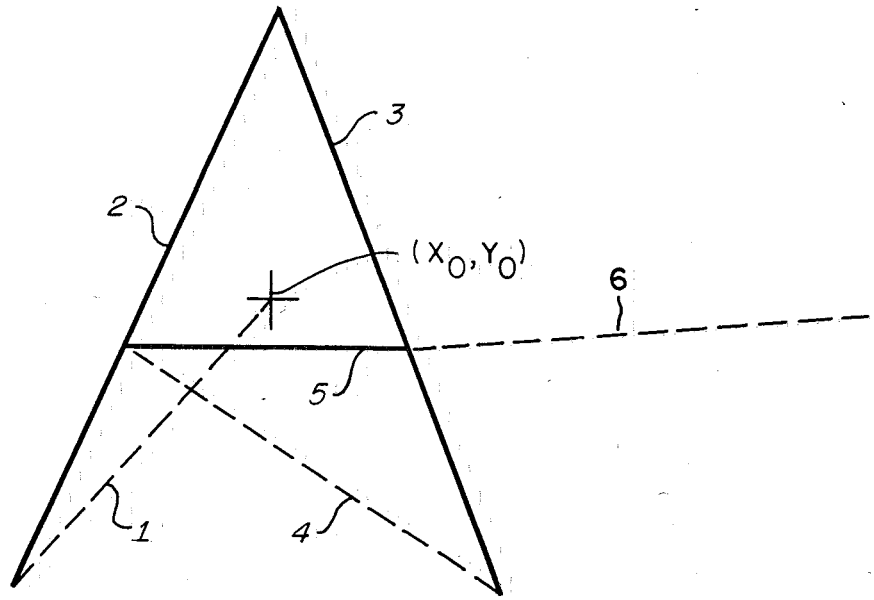
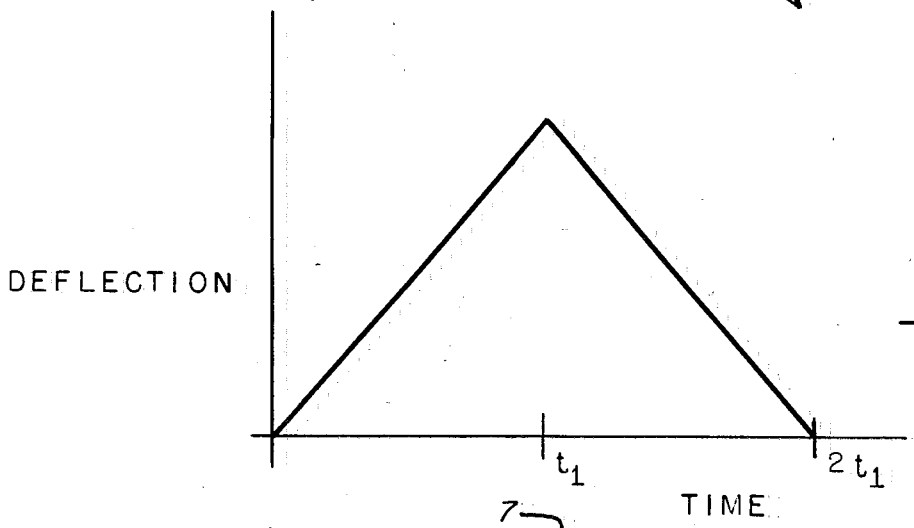
FIG. 2A.
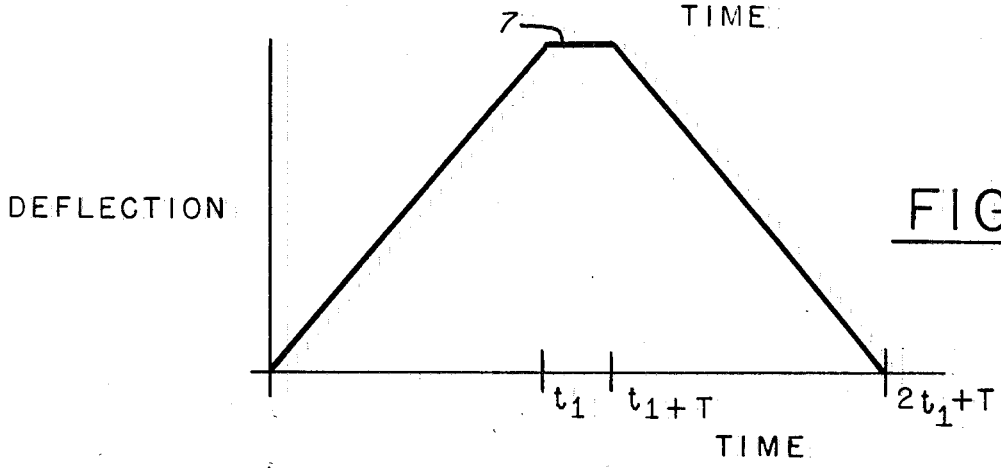
FIG. 2B.
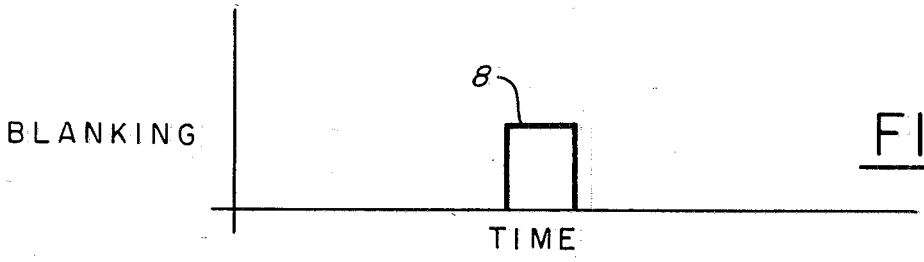
FIG. 2C.

STROKE WRITING CHARACTER GENERATOR WITH REDUCED BANDWIDTH

BACKGROUND OF THE INVENTION

1. Field of the Invention

The invention relates to electronically generated displays particularly with respect to stroke writing character generation.

2. Description of the Prior Art

Electronic displays are known wherein the characters and symbology are electroncially drawn on a display face utilizing a series of concatinated vectors to compose the characters and symbols. Such systems typically utilize a cathode ray tube (CRT) wherein the CRT beam is deflected by the deflection system to draw the vectors on the screen. The CRT video input is energized or deenergized so as to draw the vectors or to blank the vectors. Such a display is disclosed in U.S. Pat. No. 4,553,214 issued Nov. 12, 1985 in the name of the present inventor for "Angle Based Stroke Generator " assigned to the present assignee. Said U.S. Pat. No. 4,553,214 is incorporated herein in its entirety.

In such stroke or vector writing displays, numerous characters and symbols comprise sequences of consecutively drawn straight line vectors that meet at oblique or right angles defining sharp corners. In order to execute such sharp corners, high bandwidth deflection systems are required. High bandwidth deflection systems necessitate undesirably large amounts of power, complexity and cost. If, however, a low bandwidth system is utilized the sharp corners will be rounded hindering recognition of the symbology. The display of sharp corners is required for adequate character legibility.

SUMMARY OF THE INVENTION

The present invention obviates the above discussed problems of the prior art systems by inserting a time pause between the end of one stroke and the beginning of the next stroke at a corner in order to reduce the bandwidth of the deflection system. Preferably the beam is blanked during the pause.

BRIEF DESCRIPTION OF THE DRAWINGS

FIG. 1 is a schematic illustration of the stroke writing procedure for generating a letter "A".

FIG. 2*a* is a graph of deflection vs. time illustrating two consecutive vectors meeting at a sharp corner.

FIG. 2*b* is a graph of deflection vs. time illustrating the two vectors of FIG. 2*a* with a time duration pause therebetween.

FIG. 2*c* is a graph of blanking vs. time illustrating a video blanking pulse coincident with the time duration pause of FIG. 2*b*.

DESCRIPTION OF THE PREFERRED EMBODIMENT

Figure 4A:
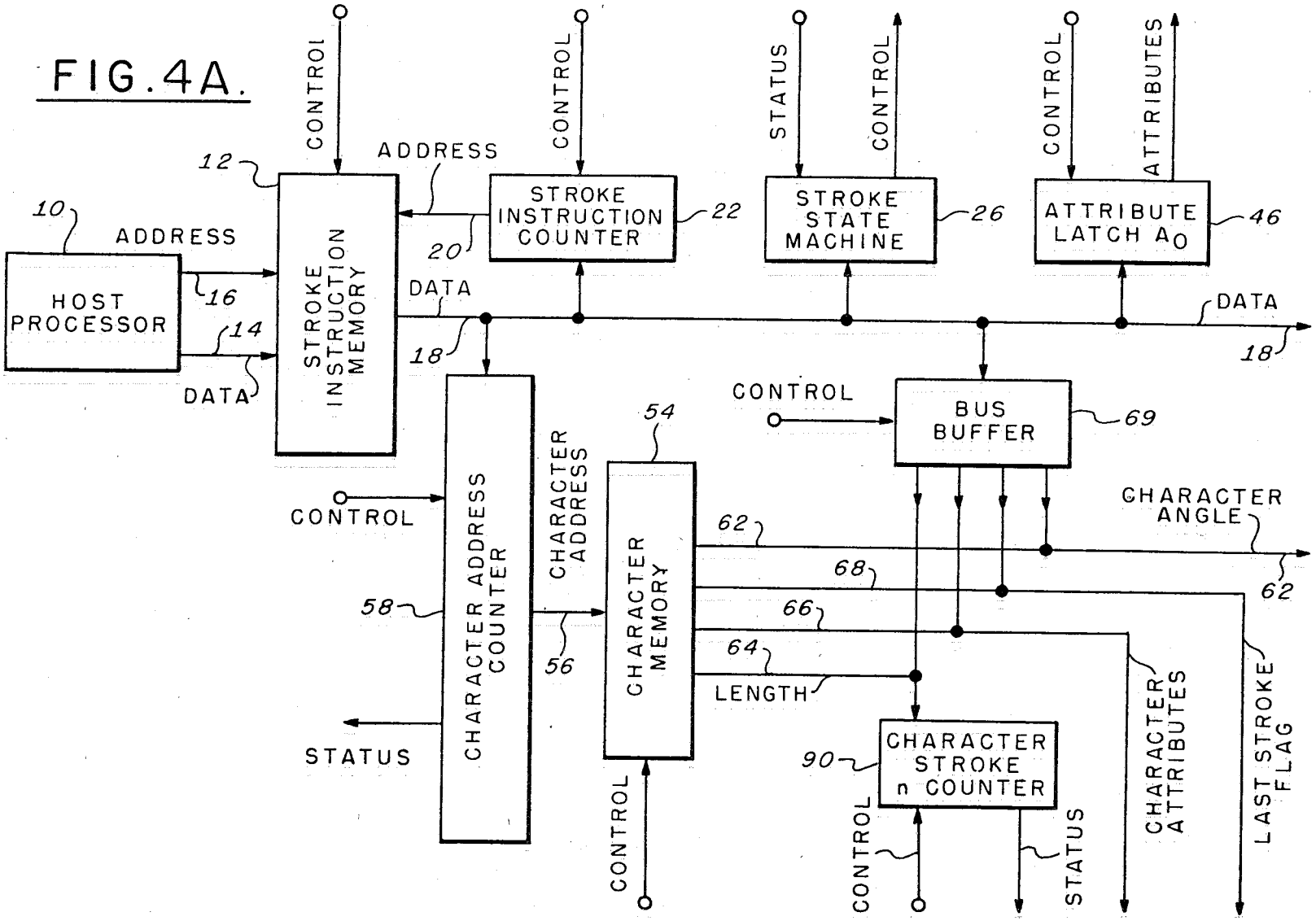
FIG. 4, comprised of FIGS. 4*a* and 4*b*, is a schematic block diagram of a stroke writing display incorporating the present invention.
Figure 4B:
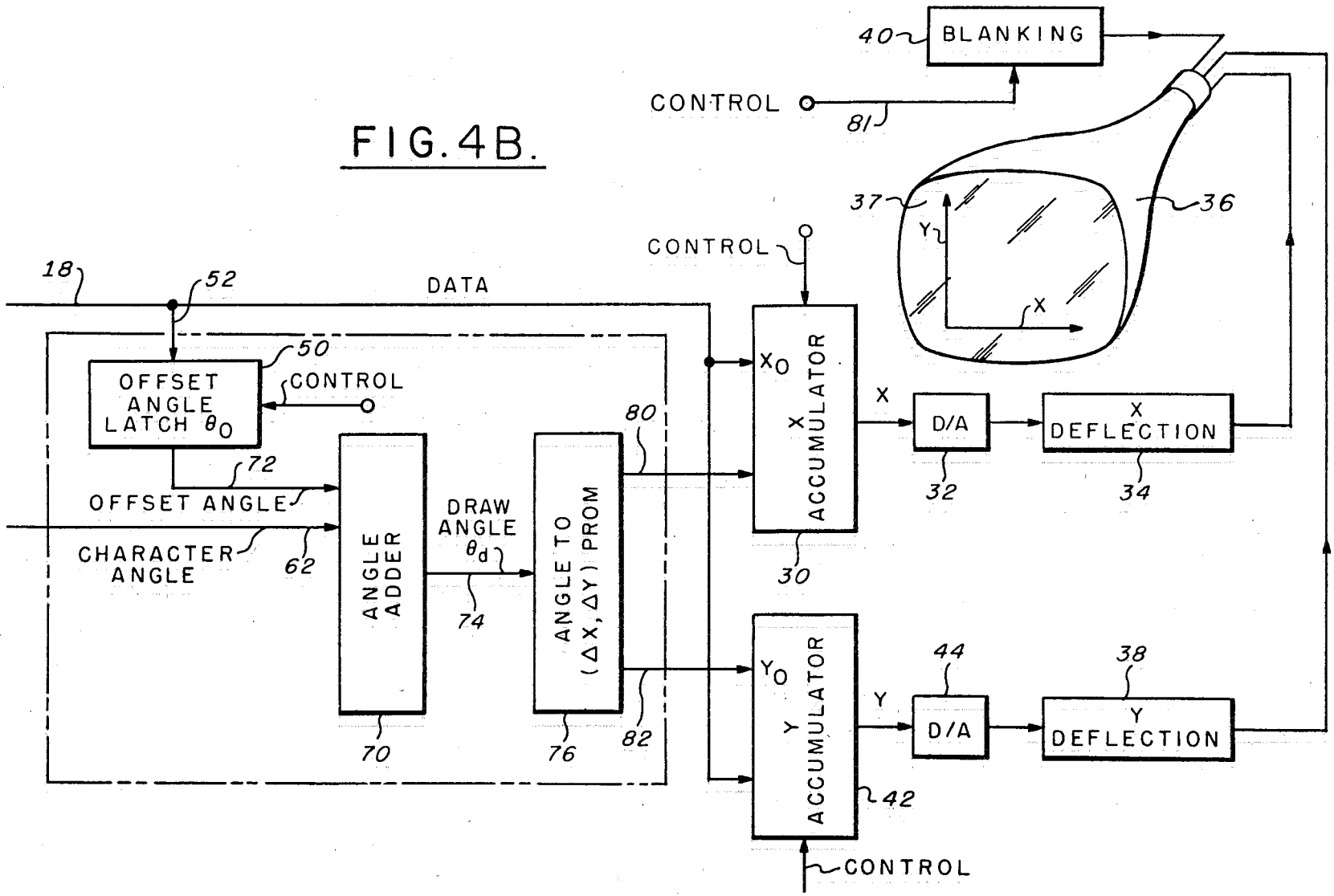

The present invention is preferably embodied in the display system of said U.S. Pat. No. 4,553,214 which is incorporated herein in its entirety. FIGS. 4*a* and 4*b* are substantially the same as FIGS. 2*a* and 2*b* of said U.S. Pat No. 4,553,214 and the modifications thereto utilized in practicing the present invention will be described below. FIG. 1 of the present application is also substantially the same as FIG 1*a* of said U.S. Pat. No. 4,553,214.

Referring to FIG. 1, the letter "A" is illustrated drawn utilizing stroke writing. The generation of this character by stroke writing was described in said U.S. Pat. No. 4,553,214. Briefly, the CRT beam is deflected through a series of sequential vectors 1–6 starting at a point ($X_0$, $Y_0$). During vectors 1, 4 and 6, the beam is blanked and during vectors 2, 3 and 5, the beam is intensified. The character illustrated in FIG. 1 demonstrates the requirement for sharp corners to maximize character legibility. It is appreciated that if the corners whereat consecutively drawn vectors meet were rounded by a low bandwidth deflection system, recognition of the symbol may be hindered. FIG. 2*a* illustrates the deflection signal that results when the beam is required to execute a sharp oblique angle at a time $t_1$. The drawing of the second of the two vectors illustrated ends at time $2t_1$.

Referring to FIG. 2*b*, the deflection signal utilized to draw the two vectors of FIG. 2*a* in accordance with the present invention is illustrated. The drawing of the first vector terminates at time $t_1$ and the drawing of the second vector begins at time $t_1+T$. Therefore, the pause inserted at the corner between the two illustrated vectors is of time duration T and is denoted by reference numeral 7. FIG. 2*c* illustrates a blanking pulse 8 to be applied to the video input of the CRT coincident with the pause 7 of FIG. 2*b*. The pause 7 interposed between successive vectors in the preferred embodiment has a duration T of one microsecond.

Figure 3:
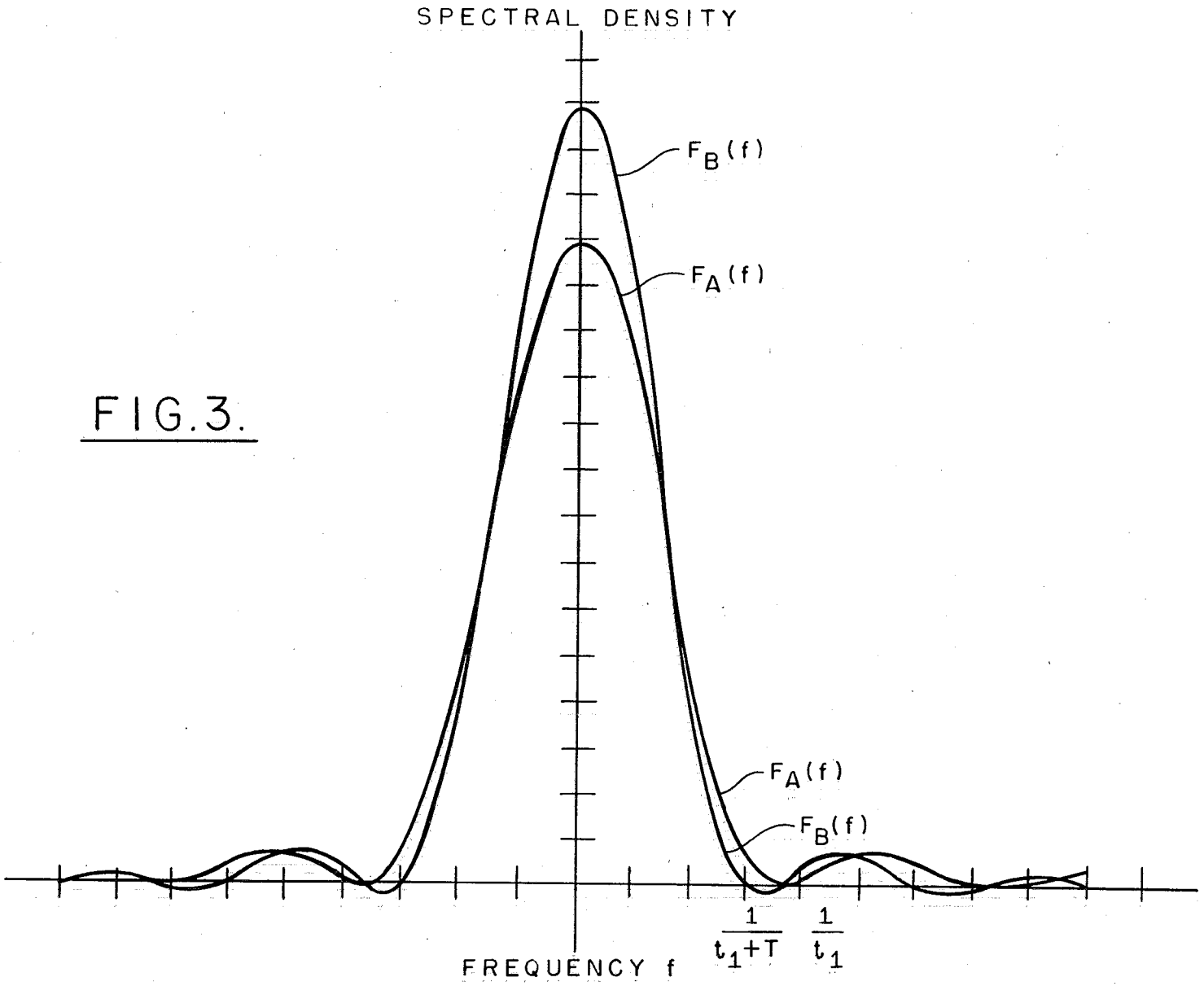
FIG. 3 is a spectral density plot of amplitude vs. frequency illustrating the conserved bandwidth when utilizing the present invention.

Referring now to FIG. 3, the frequency spectra $F_A(f)$ and $F_B(f)$ of the deflection signals of FIGS. 2*a* and 2*b* are illustrated, respectively. These frequency spectra may be expressed as follows:

$$F_A(f) = A_1 t_1 \frac{\sin \pi f t_1}{\pi f t_1} \qquad 2$$

$$F_B(f) = A_1 (t_1 + T) \frac{\sin \pi f t_1}{\pi f t_1} \quad \frac{\sin \pi f (t_1 + T)}{\pi f (t_1 + T)}$$

It is appreciated that these frequency spectra are of the form $(\sin X/X)^2$.

To quantitatively determine the bandwidth reduction benefit of the invention, the bandwidths of the two spectral density plots $F_A$ and $F_B$ are compared at equal energy levels. For convenience, the comparison is effected with respect to the first zero crossings of the plots which provides 92% of the total energy thereof. The pause T reduces the zero crossing frequency from $1/t_1$ to $1/(t_1+T)$. This is a bandwidth reduction of $$\frac{1/t_1 - 1/(t_1 + T)}{1/t_1} \times 100\%$$

$$\frac{T}{t_1 + T} \times 100\%$$

for a corresponding time increase of $$\frac{T}{t_1 + T} \times 100\%$$

which is a 1 to 1 ratio.